US007100226B1

(12) United States Patent
Walton

(10) Patent No.: US 7,100,226 B1
(45) Date of Patent: Sep. 5, 2006

(54) PADDED SPINAL BOARD COVERSLIP

(76) Inventor: Ross T. Walton, 316 Creekwood Dr., Bardstown, KY (US) 40004

( * ) Notice: Subject to any disclaimer, the term of this patent is extended or adjusted under 35 U.S.C. 154(b) by 0 days.

(21) Appl. No.: 11/108,082

(22) Filed: Apr. 15, 2005

(51) Int. Cl.
*A61G 1/04* (2006.01)
*A61G 1/00* (2006.01)

(52) U.S. Cl. ..... 5/626; 5/625; 5/691; 128/870

(58) Field of Classification Search ..... 5/625, 5/626, 627, 628, 629, 499, 691, 636, 484; 128/870, 869
See application file for complete search history.

(56) References Cited

U.S. PATENT DOCUMENTS

| | | | | |
|---|---|---|---|---|
| 30,588 | A | 11/1860 | Pitts | |
| 2,517,443 | A | 8/1950 | Rhodes | |
| 5,088,137 | A | 2/1992 | Rose | |
| 5,481,770 | A | 1/1996 | Ahlsten | |
| 5,819,746 | A | 10/1998 | Walton | |
| 6,067,678 | A * | 5/2000 | Trevino | 5/628 |
| 6,138,306 | A * | 10/2000 | Muhanna | 5/706 |
| 6,634,042 | B1 * | 10/2003 | Blossman | 5/499 |
| 6,848,134 | B1 * | 2/2005 | Schenck | 5/625 |

* cited by examiner

*Primary Examiner*—Alexander Grosz
(74) *Attorney, Agent, or Firm*—Donald K. Wedding; Michael D. Carbo

(57) ABSTRACT

The following invention describes a padded coverslip for a long spinal board. The padding may be composed of a foam core that has a waterproof covering. The shape of the pad may vary to allow it to fit onto any adult size long spinal board. Additional sizes of the pad are also included for pediatric spinal boards. Additional integrated padding may be incorporated at the head of the pad in order to elevate the head of the patient to an anatomically neutral position. Emanating from the sides of the padding is an elastic coverslip that would wrap around a spinal board, securing the pad to the board. Openings within the coverslip would correspond with handhold slots along the sides of the spinal boards.

4 Claims, 6 Drawing Sheets

PADDED SPINAL BOARD COVERSLIP

CROSS-REFERENCE TO RELATED APPLICATION

None

STATEMENT REGARDING FEDERALLY SPONSORED RESEARCH OR DEVELOPMENT

None

REFERENCE TO A "SEQUENCE LISTING"

None

BACKGROUND OF THE INVENTION (1) Field of the Invention

This invention has its use in the immobilization of victims of trauma suspected of having possible spinal cord injuries.

(2) Description of Related Art

Presently either wooden or synthetic boards transport victims of trauma from the scene of injury to a hospital. Often these patients must remain secured to the device for several hours. Multiple studies have demonstrated that these devices are extremely uncomfortable and can cause decubitus ulcer formation in certain high-risk individuals such as those paralyzed as a result of their injuries. Furthermore placing patients flat on these boards results in the neck resting in an anatomically hyperextended position. A study from 1993 demonstrated that the addition of padding to these boards improves patient comfort and may decrease the likelihood of decubitus ulcer formation without compromising spinal immobilization. Other research has shown that additional padding to support the head places the spine in an anatomically neutral position and may therefore decrease the risk of cervical spine injury.

Conventional spinal pads have numerous shortcomings. Many are of excessive width that precludes the transporter from placing his or her hand inside the handholds on the sides of the underlying backboard. Some pads secure to spinal boards with straps that cross beneath the board, preventing the user from being able to slide the board when necessary. Some spinal pads are incorporated into the construction of the underlying board. These function well but are prohibitively expensive to many ambulance companies whose patients could benefit from a pad that adapts to the spinal boards they already have in use. U.S. Pat. No. 5,819,746 to Walton discloses removable spinal cord padding having padding that elevates the head of a patient to an anatomically neutral position and having slots within the padding to permit securing straps to slide freely within the padding.

None of the conventional spinal pads have a coverslip that emanates from the sides of the spinal pad and that wraps around a spinal board, thereby securing the pad to the board.

BRIEF SUMMARY OF THE INVENTION

The present invention alleviates the abovementioned disadvantages inherent in spinal pads currently in use. The apparatus consists of a foam core. The core may be composed of polyurethane, polyvinyl chloride or other pliable material. A waterproof and optionally washable cover would enclose the foam core.

The dimensions of the pad according to the invention are such that it is adequately narrow to allow handholds on conventional adult spinal boards to be exposed. Optionally, the pad is equal in width to the board with recessed areas to expose the handholds of the spinal board.

The end of the pad that accommodates the patient's head may taper when viewed from above to allow the pad's use on boards that have similar tapering.

An elastic coverslip projects from each side of the padded cover. This coverslip serves to wrap around and grip the spinal board. The padded coverslip is placed on the board by sliding it onto one end of the board.

Openings in either the pad or the coverslip correspond in location to the handholds within the spinal board.

The entire device may be offered in a variety of sizes to accommodate different shapes and sizes of boards, including pediatric spinal boards.

BRIEF DESCRIPTION OF THE SEVERAL VIEWS OF THE DRAWINGS

The above features and advantages of this invention are illustrated in the following drawings where.

DETAILED DESCRIPTION OF THE INVENTION

Figure 1:
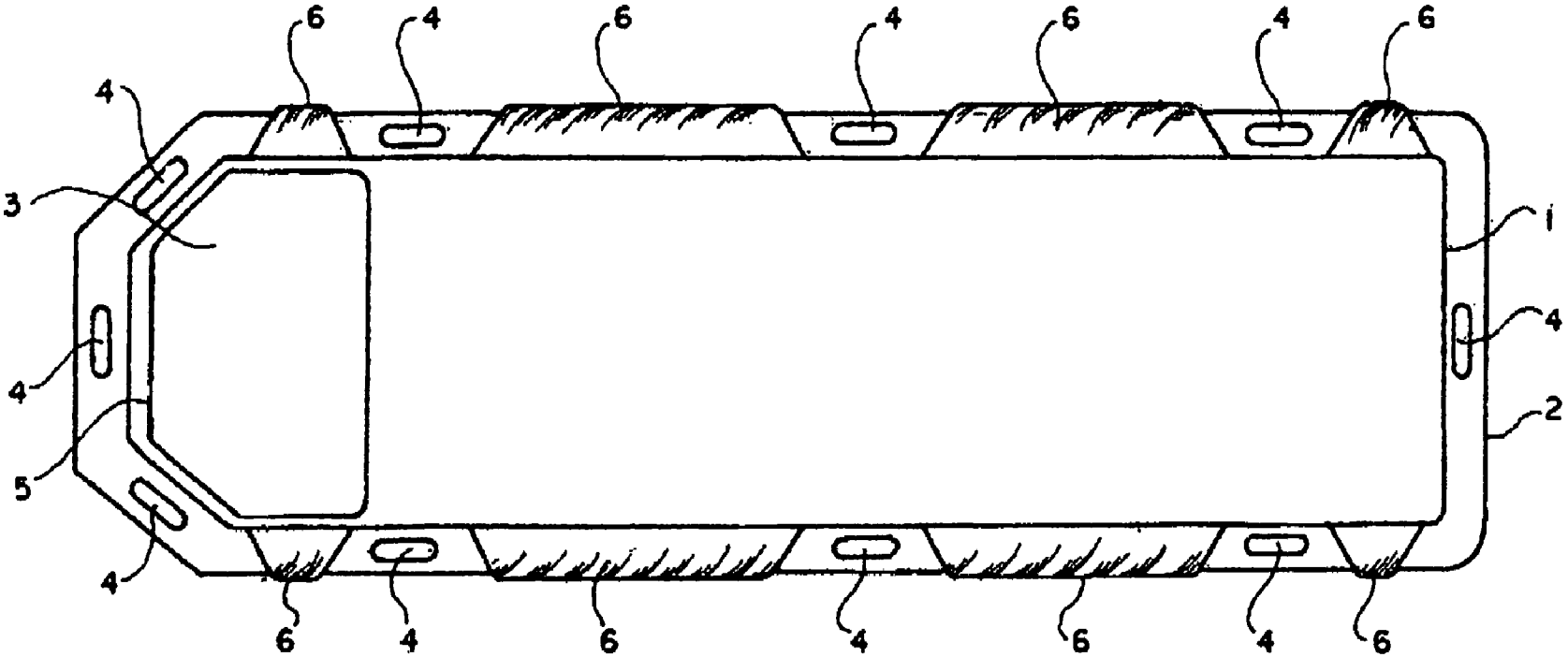
FIG. 1 is a top plan view of a padded spinal board coverslip according to an embodiment of the invention showing the pad resting on top of a long spinal board.

The disclosed invention improves patient care with respect to trauma victims (also called a "patient") suspected of having cervical spine injuries. As shown in FIG. 1, pad 1 has edges within the inner limits of the handholds 4 within the long spinal board 2. Alternatively, the edges of the pad 1 may extend to the edges of the long spinal board 2, but the edges of the pad 1 would be recessed to the inner limits of the handholds 4 where they are present on the long spinal board 2.

Figure 2:
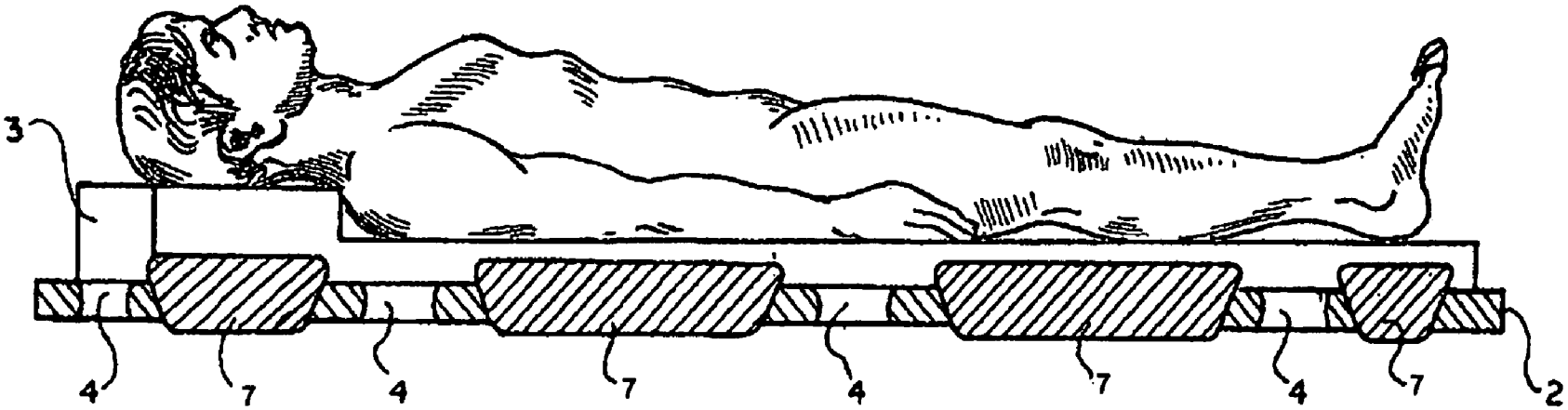
FIG. 2 is a side view of the padded spinal board coverslip shown in FIG. 1, showing the padded spinal board coverslip on top of a long spinal board.

The headward end 5 of pad 1 that accommodates a patient's head when viewed from the top tapers as to follow the contour of many spinal boards with similar tapering. Head pad 3 follows this same contour. Hence, head pad 3 and the tapered end 5 of the spinal pad 1 will not encroach upon the handholds of the headward end of the long spinal board 2. FIGS. 1 and 2 depict the limited length of the head pad 3 from the top of the head footward. Head pad 3 will thus not encroach upon the neck where a cervical immobilization collar would be worn by a patient, thus maintaining the cervical spine in an anatomically neutral position.

Figure 1A:
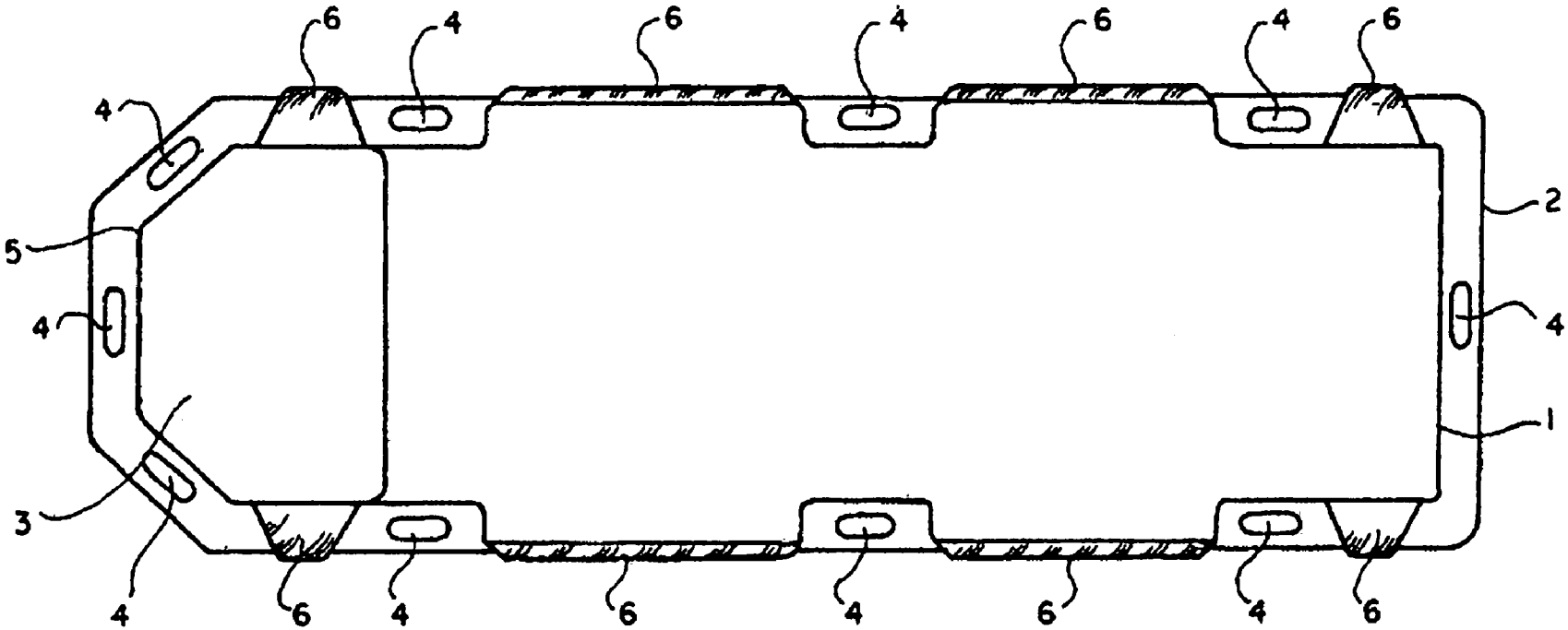
FIG. 1*a* is a top plan view of a padded spinal board coverslip according to an alternative embodiment of the invention, showing the pad resting on top of a long spinal board, the pad extending to the edges of the spinal board and having recesses to allow for clearance of the long spinal board handholds.

FIGS. 1, 2, 3 AND 4 depict the elastic coverslip 6 projecting from the sides of the pad 1. These projections are interrupted in order to allow for clearance of the spinal board handholds 4. FIG. 1*a* alternatively demonstrates the spinal pad 1 extending to the edges of the long spinal board 2. Here the pad has recesses to allow for clearance of the spinal board handholds 4. The elastic coverslip 6 extends around the long spinal board 2. Tension from the elastic nature of the coverslip 6 maintains the pad 1 securely attached to the long board 2.

Figure 3:
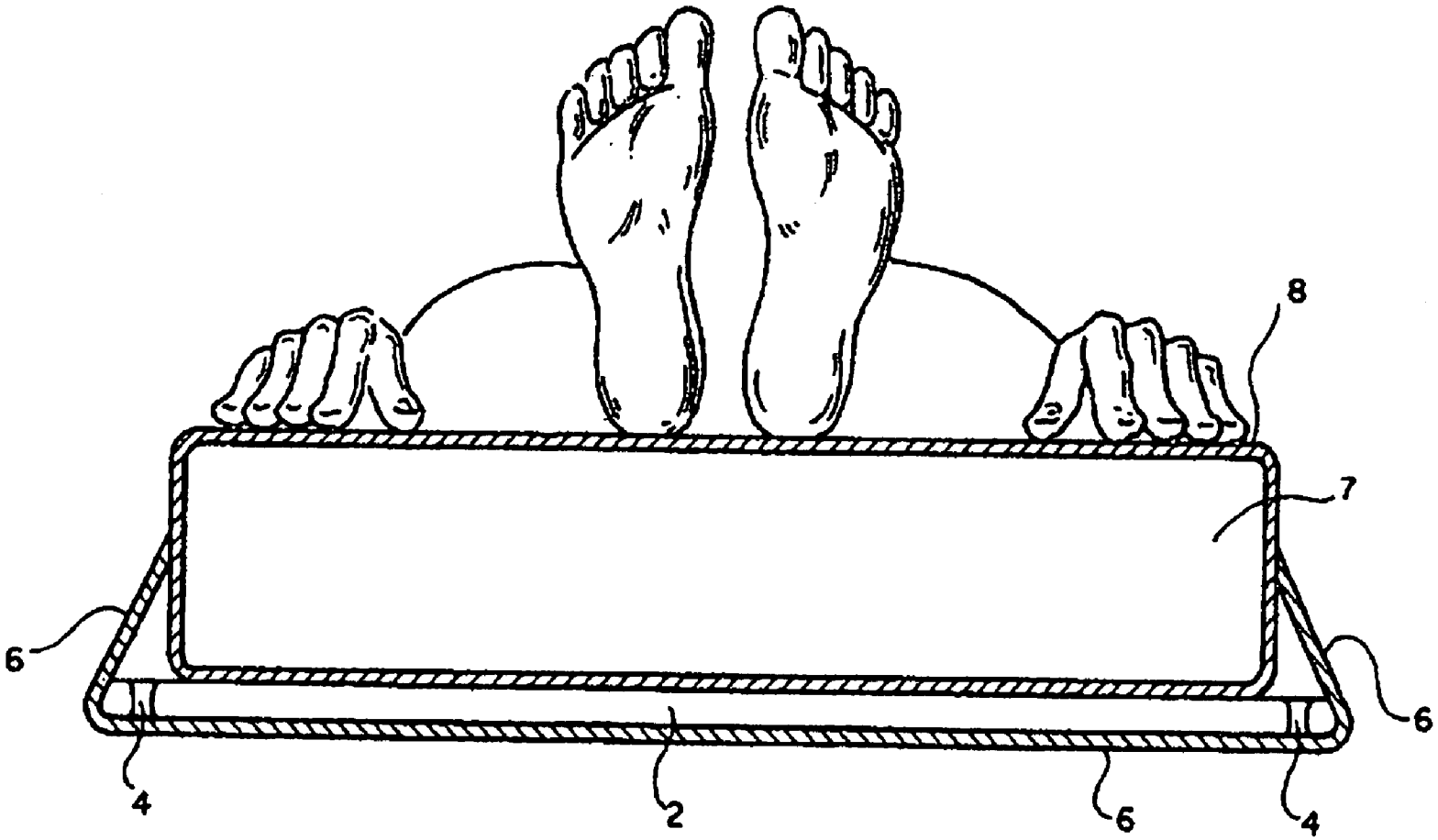
FIG. 3 is a transverse sectional view of the padded spinal board coverslip shown in FIG. 1, showing the padded spinal board coverslip on top of a long spinal board. The section shown is at the level of the patient's torso.
Figure 4:
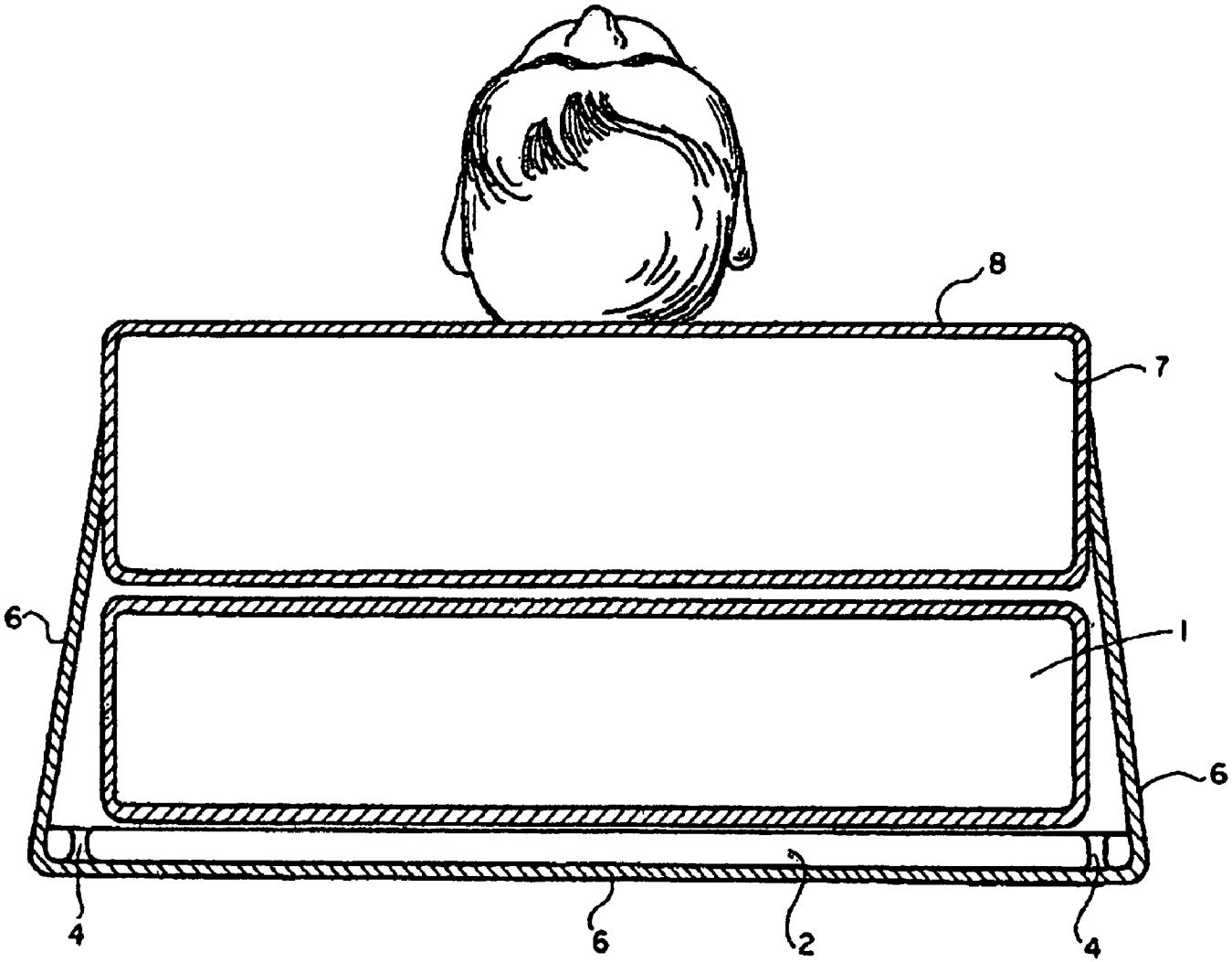
FIG. 4 is a transverse sectional view of the padded spinal board coverslip shown in FIG. 1, the section shown being at the level of the patient's head.
Figure 5:
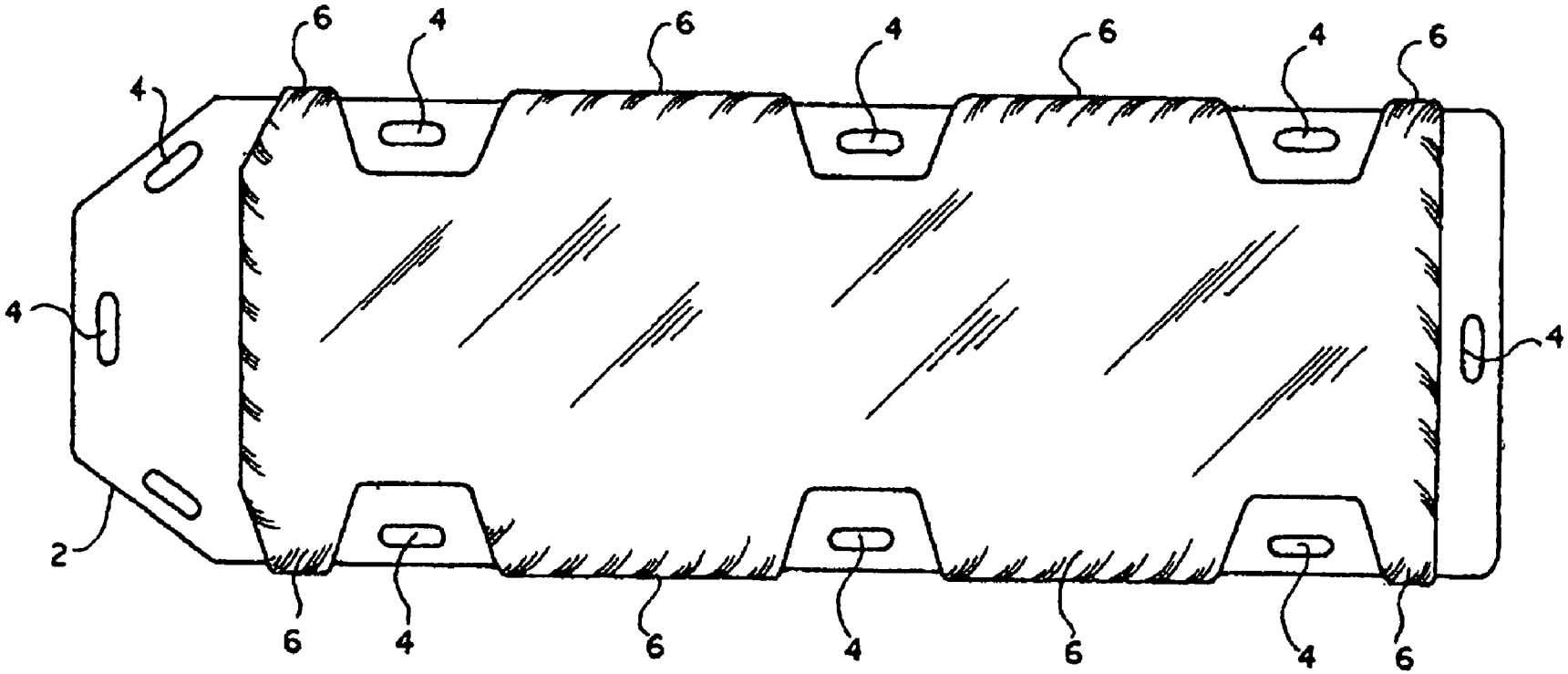
FIG. 5 is a bottom plan view of an embodiment of a padded spinal board coverslip according to an embodiment of the invention, showing the coverslip on the bottom surface of a long spinal board.

FIGS. 3 and 4 are transverse cross-sections of the pad 1 resting atop the long spinal board 2. The foam core 7 is shown enclosed by a waterproof covering 8 in both of these drawings. FIG. 4 demonstrates the additional head pad 3 atop the pad 1.

I claim:

1. A spinal padding apparatus, comprising:

(1) contoured spinal padding having a width less than a minimum distance between sideholds of an associated spinal board, having a length such that the end handholds of the associated spinal board are not covered by the spinal padding;

(2) additional padding at the area of the patient's head that would place the patient's neck in an anatomically neutral position, when the patient is placed in the spinal board;

(3) the spinal padding and the additional padding being tapered when viewed from above so as to follow the contour of any associated spinal board which may be tapered;

(4) the additional padding being connected to the spinal padding either as one piece or as two separate pieces connected together, and wherein the additional padding does not extend into the area where the patient's neck would be in order to maintain the cervical spine in an anatomically neutral position; and (5) an elastic coverslip projecting from the sides of the spinal padding or the head padding, or both, the elastic coverslip wrapping around the associated spinal board to secure the spinal padding to the associated spinal board, and the coverslip having openings to allow for clearance of the handholds along the sides of the associated spinal board.

2. The apparatus according to claim 1, wherein a core of the spinal padding comprises polyurethane or other type of pliable material and wherein the spinal padding is covered with a polyvinyl chloride or other water-proof barrier.

3. A spinal padding apparatus, comprising:

(1) contoured spinal padding having a width and/or length equal to the width and/or length of an associated spinal board, with recesses allowing for clearance of the handholds of an associated spinal board;

(2) additional padding at the area of the patient's head that would place the patient's neck in an anatomically neutral position, when the patient is placed in the spinal board;

(3) the spinal padding and the additional padding being tapered when viewed from above so as to follow the contour of any associated spinal board which may be tapered;

(4) the additional padding being connected to the spinal padding either as one piece or as two separate pieces connected together, and wherein the additional padding does not extend into the area where the patient's neck would be in order to maintain the cervical spine in an anatomically neutral position; and (5) an elastic coverslip projecting from the sides of the spinal padding or the head padding, or both, the elastic coverslip wrapping around the associated spinal board to secure the spinal padding to the associated spinal board, and the coverslip having openings to allow for clearance of the handholds along the sides of the associated spinal board.

4. The apparatus according to claim 3, wherein a core of the spinal padding comprises polyurethane or other type of pliable material and wherein the spinal padding is covered with a polyvinyl chloride or other water-proof barrier.

* * * * *